US007114635B2

(12) United States Patent
Yamada

(10) Patent No.: US 7,114,635 B2
(45) Date of Patent: Oct. 3, 2006

(54) CONTAMINATION PREVENTIVE CAP

(75) Inventor: Hiroshi Yamada, Kashiwara (JP)

(73) Assignee: Santen Pharmaceutical Co., Ltd., Osaka (JP)

( * ) Notice: Subject to any disclaimer, the term of this patent is extended or adjusted under 35 U.S.C. 154(b) by 148 days.

(21) Appl. No.: 10/513,774

(22) PCT Filed: May 9, 2003

(86) PCT No.: PCT/JP03/05855

§ 371 (c)(1),
(2), (4) Date: Nov. 8, 2004

(87) PCT Pub. No.: WO03/095325

PCT Pub. Date: Nov. 20, 2003

(65) Prior Publication Data

US 2005/0224516 A1 Oct. 13, 2005

(30) Foreign Application Priority Data

May 10, 2002 (JP) ..... 2002-135419

(51) Int. Cl.
*B67D 5/00* (2006.01)

(52) U.S. Cl. ..... 222/83; 222/81; 222/189.06; 222/189.09; 222/212; 222/494

(58) Field of Classification Search ..... 222/80–83, 222/83.5, 86–88, 562, 189.06, 189.09, 212–215, 222/541.2, 525, 490–494, 541.4, 518, 541.5, 222/509, 541.6, 481, 481.5, 476; 137/512, 137/512.4, 512.15
See application file for complete search history.

(56) References Cited

U.S. PATENT DOCUMENTS 3,221,952 A * 12/1965 De See ..... 222/525
3,519,157 A * 7/1970 Meierhoefer ..... 215/11.6
4,412,623 A * 11/1983 Schmidt ..... 215/11.1

(Continued)

FOREIGN PATENT DOCUMENTS

JP 39-11991 U 5/1964

(Continued)

*Primary Examiner*—Frederick C. Nicolas
(74) *Attorney, Agent, or Firm*—The Webb Law Firm

(57) ABSTRACT

An antipollution cap comprises a base member (7) attachable to an eyedrops container (A) for containing a fluid, a overcap (8) mountable on the base member (7), a pressing member (9) inserted into and held by the base member (7) to be slidable relative thereto, with a groove portion (91) formed in a side face thereof for guiding the fluid to the outside, the pressing member being pressed toward the eyedrops container (A) by the overcap (8) to cancel a sealed condition of the eyedrops container (A), a first tight contact member (11) provided on a tip end portion (77) of the base member (7) to be placed in tight contact with the pressing member (9) from outside and yet allow the fluid to be discharged therethrough, and a second tight contact member (12) provided on an inner periphery of the base member (7) to be placed in tight contact with the pressing member (9) in a pressed position thereby preventing the fluid from being discharged therethrough and yet allowing ambient air to flow therein.

6 Claims, 10 Drawing Sheets

U.S. PATENT DOCUMENTS 4,570,826 A * 2/1986 Fattori ..... 222/83
5,154,325 A * 10/1992 Ryder et al. ..... 222/189.06
5,310,094 A * 5/1994 Martinez et al. ..... 222/212
5,447,257 A * 9/1995 Dark ..... 222/336
5,680,970 A * 10/1997 Smith et al. ..... 222/514
5,971,224 A * 10/1999 Garibaldi ..... 222/207
5,992,692 A * 11/1999 Boissay ..... 222/83
6,000,578 A * 12/1999 Boissay ..... 222/83
6,412,659 B1 * 7/2002 Kneer ..... 222/82
6,659,308 B1 * 12/2003 Kelder et al. ..... 222/83

FOREIGN PATENT DOCUMENTS

JP 8-183555 A 7/1996

* cited by examiner (a)

(b)

CONTAMINATION PREVENTIVE CAP

TECHNICAL FIELD

This invention relates to an antipollution cap mounted on a medical eyedrops container (hereinafter simply called "eyedrops container") for containing medical eyedrops for instillation.

BACKGROUND ART

Examples of existing eyedropper, especially those for applying a medical fluid such as medical eyedrops, which are in wide use, are what is called a three-piece type eyedropper including a main container body in the form of a hollow cylinder, with an instilling tube attached thereto, and with a cap mounted on the main container body to make three components forming a whole eyedropper, and, as shown in FIG. 11, what is called a bottle pack eyedropper X which may be an integral molding type container A, with an instilling tube 6 and a main container body 10 formed integrally by blow molding or vacuum forming technique, and with a cap B screwed or fitted to the container A. It is also known that the instilling tube 6 has a stopper with an instilling opening 6*a* mounted on a tip end of the tube (see FIGS. 1 and 2 of Japanese Utility Model Publication No. 39-11991). As a material of the eyedropper X of this type, a soft thermoplastic resin is used because it is easy to form and so on.

When the medical fluid contained in the eyedrops container A is applied with this type of eyedropper X, a barrel 2 of the eyedrops container A (main container body 10) is held by tips of two digits to keep an applying posture where the instilling opening 6*a* of the eyedrops container A faces the eye to receive the fluid. The barrel 2 is pressed toward an axis of the container while maintaining the applying posture, whereby the medical fluid is distilled and applied from the instilling opening 6*a*.

Since the medical fluid, especially medical eyedrops are applied directly to the eye which is an especially sensitive organ in the human body, it is strictly required to maintain them in aseptic condition until instillation. Therefore, an aseptic filling is required to be carried out in an aseptic room meeting strict conditions after sterilizing each component of the above-noted eyedropper with steam sterilization or with EO gas sterilization, and after sterilizing the medial fluid with sterilization by filtration using a membrane filter and so on.

With the eyedrops container of the above conventional eyedropper (the integral molding type container, for example), the eyedrops container is filled with the medical fluid in aseptic condition and then the cap is mounted on the eyedrops container to seal the container. Thus, the medical fluid contained in the eyedrops container can be prevented from directly contacting ambient air, as a result of which the medical fluid can usually be maintained in aseptic condition until the cap is released for instillation.

However, as the medical fluid is distilled and applied from the instilling opening after the eyedrops container is opened, ambient air flows into the eyedrops container from the instilling opening in a volume corresponding to the medical fluid applied. At this time, the aseptic condition within the eyedrops container cannot be secured because of germs present in the ambient air or the like, which might pollute the interior of the eyedrops container (interior pollution of the eyedrops container after it is opened).

In order to avoid such interior pollution, a method of filling the eyedrops container with the medical fluid added with an antiseptic solution in advance is in wide use (antiseptic treatment of the medical fluid).

On the other hand, attempts have been made to prevent the germs present in ambient air being taken into the eyedrops container. The present invention has been made from this point of view.

Incidentally, a completely integrally formed and sealed eyedrops container is in wide use, which container dispenses with the instilling opening for discharging the medical fluid in order to avoid contact with ambient air. It is desirable to provide a cap advantageously mounted on such an eyedrops container in a sealed condition.

Therefore, the object of the present invention is to provide a cap for mounting on a container in a sealed condition containing a fluid and capable of preventing the fluid from contacting ambient air before the container is opened and preventing pollution of the container interior after it is opened.

DISCLOSURE OF THE INVENTION

A characteristic construction of an antipollution cap according to the present invention will be described hereinafter.

As illustrated in FIG. 1, the first characteristic feature according to the present invention is that the cap comprises a base member 7 attachable to a main container body 10 for containing a fluid, a overcap 8 mountable on the base member 7, a pressing member 9 inserted into and held by the base member 7 to be slidable relative thereto, with a groove portion 91 formed in a side face thereof for guiding the fluid to the outside, the pressing member being pressed toward the main container body 10 by the overcap 8 to cancel a sealed condition of the main container body 10, a first tight contact member 11 provided on a tip end portion 77 of the base member 7 to be placed in tight contact with the pressing member 9 from outside and yet allow the fluid to be discharged therethrough, and a second tight contact member 12 provided on an inner periphery of the base member 7 to be placed in tight contact with the pressing member 9 in a pressed position thereby preventing the fluid from being discharged therethrough and yet allowing the external air to flow therein.

Since the antipollution cap according to the present invention consists of the base member, the overcap, the pressing member, the first tight contact member and the second tight contact member, the main container body containing the fluid in the sealed condition may be used. The reason for this is as follows.

The cap is mounted on the main container body in the sealed condition by attaching the base member to the body. In use, the pressing member is shifted from a non-pressed position where the pressing member is not pressed toward the main container body to a pressed position where the pressing member is pressed toward the main container body by the overcap attached to the base member, thereby to cancel the sealed condition of the main container body. Hence, the fluid contained in the main container body can be discharged from the main container body.

More particularly, when the antipollution cap of the present invention is mounted on the main container body in the sealed condition, the pressing member is not pressed in in a non-use state, and thus the fluid is prevented from contacting ambient air before the container is opened, thereby to reliably maintain the sealed condition of the main container body in the non-use state. The cap is fitted to the main container body by pressing the pressing member, thereby to reliably cancel the sealed condition of the main container body.

The fluid discharged from the main container body is guided to the outside from the groove portion formed in the side face of the pressing member. At this time, the second tight contact member provided on the inner periphery of the base member is placed in tight contact with the pressing member, which prevents the fluid from discharging to the outside through any other passages than the groove portion. Thus, the fluid can be prevented from leaking from the main container body in use.

Further, the first tight contact member provided on the tip end portion of the base member and placed in tight contact with the pressing member from outside is readily moved away from the pressing member by the pressure of the fluid guided by the groove portion, thereby to discharge the fluid to the outside. Thus, the fluid can be easily applied.

As illustrated in FIG. 1, the second characteristic feature according to the present invention is that, in the first characteristic feature, the pressing member 9 includes one end in the form of a needle adjacent the main container body 10.

According to this construction, even in the sealed container capable of reliably maintaining the aseptic condition until use, the one end of the main container body in the form of a needle can readily and reliably cancel the sealed condition by shifting the pressing member from the non-pressed position to the pressed position.

As illustrated in FIG. 6, the third characteristic feature according to the present invention is that, in the first or second characteristic feature, a filter member 78 is provided to be held by the pressing member 9 and the base member 7 with the pressing member 9 being pressed in.

With this construction, ambient air flows into the main container body in a volume corresponding to the fluid applied in use after the sealed condition of the main container body is canceled for use. At this time, the air flows into the main container body through between the pressing member and the base member. According to this construction, the filter member is provided between the pressing member and the base member to capture microorganisms and the like present in the air. This facilitates adequately securing the aseptic condition of the fluid contained in the main container body after the container is opened. As a result, pollution of the interior of the main container body after it is opened can be prevented to effectively prevent pollution of the fluid, which hardly requires any antiseptic.

Further, since the filter member is held by the pressing member and the base member with the pressing member being pressed in, the filter member is pressed by the pressing member when the latter is placed in the pressed position. Thus, the filter member can be prevented from being pressed until use, thereby to adequately preserve the shape and the filtering function of the filter member without deteriorating them until use.

As illustrated in FIG. 7, the fourth characteristic feature according to the present invention is that, in the third characteristic feature, the base member 7 includes a first base member 7*a* and a second base member 7*b*, the filter 78 being fixed at an outer periphery thereof by the first base member 7*a* and the second base member 7*b* before pressing member 9 is pressed in.

With this construction, the filter member is fixed at the outer periphery thereof by the first base member and the second base member, thereby to stabilize the position of the filter member. Thus, the filter member is not held by the pressing member and the base member in an abnormal position when the pressing member is placed in the pressed position, thereby to reliably perform the filtering function.

As illustrated in FIG. 2, the fifth characteristic feature according to the present invention is that, in the fourth characteristic feature, the overcap 8 includes a cap body 8*a* and a cutoff portion 8*b* to be cut off from the cap body 8*a*, the cap body 8*a* being placed in contact with the base member 7 when it is pressed in after the cutoff portion 8*b* is removed.

With this construction, since the overcap includes the cap body and the cutoff portion to be cut off from the cap body, the cap body cannot be pressed in toward the main container body (pressed position) unless the cutoff portion is cut off from the cap body.

Hence, it is possible to prevent the pressing member from being pressed in because the cutoff portion is placed in contact with the base member before use of the eyedrops container. Further, in use of the eyedrops container, it is possible to prevent the pressing member from being pressed in more than necessary because the cap body is placed in contact with the base member.

As illustrated in FIGS. 8 and 9, the sixth characteristic feature according to the present invention is that, in the fifth characteristic feature, projections 79 are dispersed on the tip end portion of the base member 7 for restraining the first tight contact member 11 from being deformed toward the base member 7, the projections 79 being arranged close to the first tight contact member 11.

When the pressing member is placed in the pressed position, the first tight contact member has a chance of being deformed toward the base member by the pressure between the pressing member and the first tight contact member. However, when the first tight contact member is deformed toward the base member, the first tight contact member contacts the projections generally evenly around the tip end portion of the base member if the projections are dispersed on the tip end portion of the base member. Hence, the first tight contact member may be deformed, but its irregular distortion hardly occurs. This prevents the medical fluid from discharging irregularly.

Further, since the projections are arranged close to the first tight contact member, the first tight contact member is placed in contact with the projections immediately when the first tight contact member is about to deform toward the base member, thereby to stop movement of the first tight contact member. As a result, deformation of the first tight contact member can be minimized, if any.

BRIEF DESCRIPTION OF THE DRAWIGNS

BEST MODE FOR CARRYING OUT THE INVENTION

Figure 1:
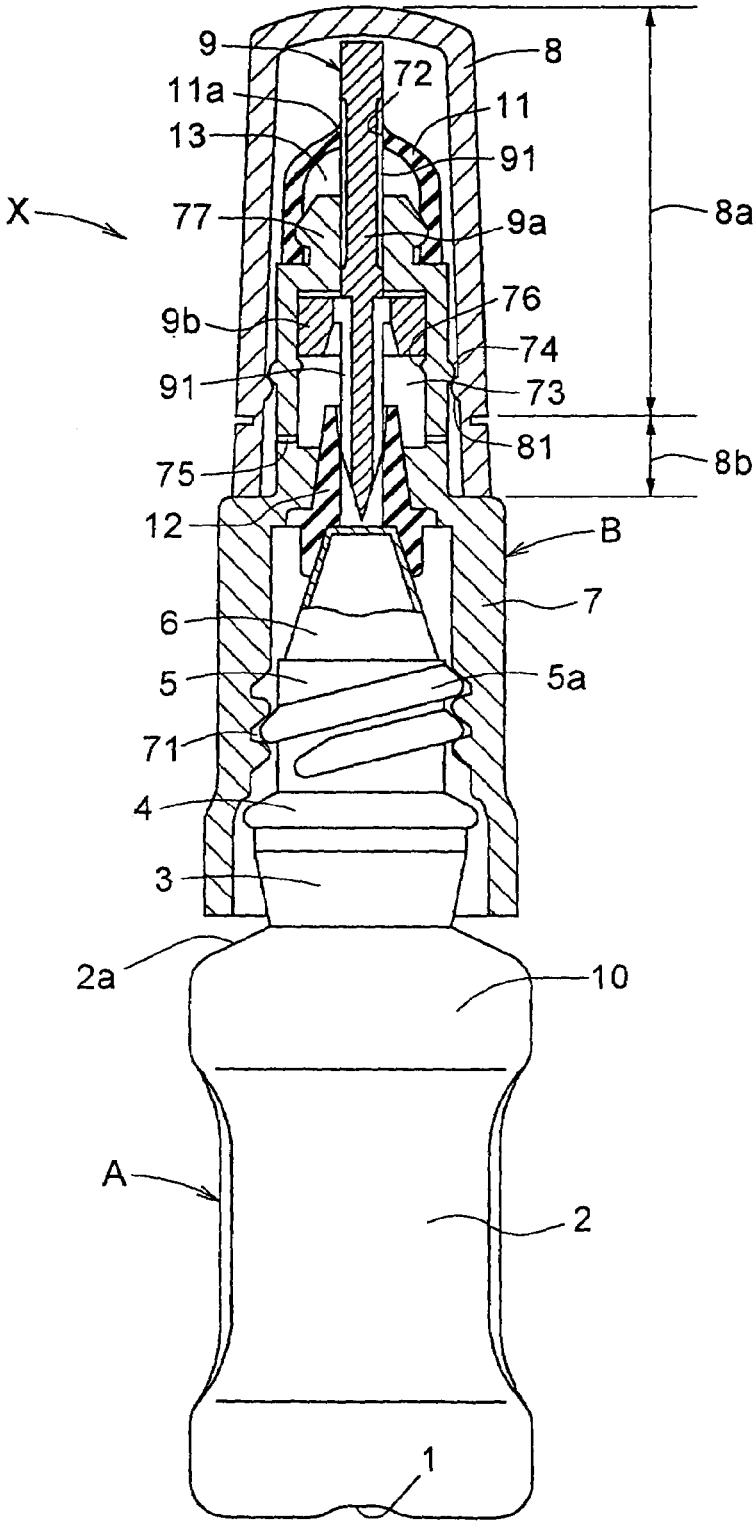
FIG. 1 is a schematic view showing a state in which a cap and a main container body according to the present invention are screwed together.
Figure 2:
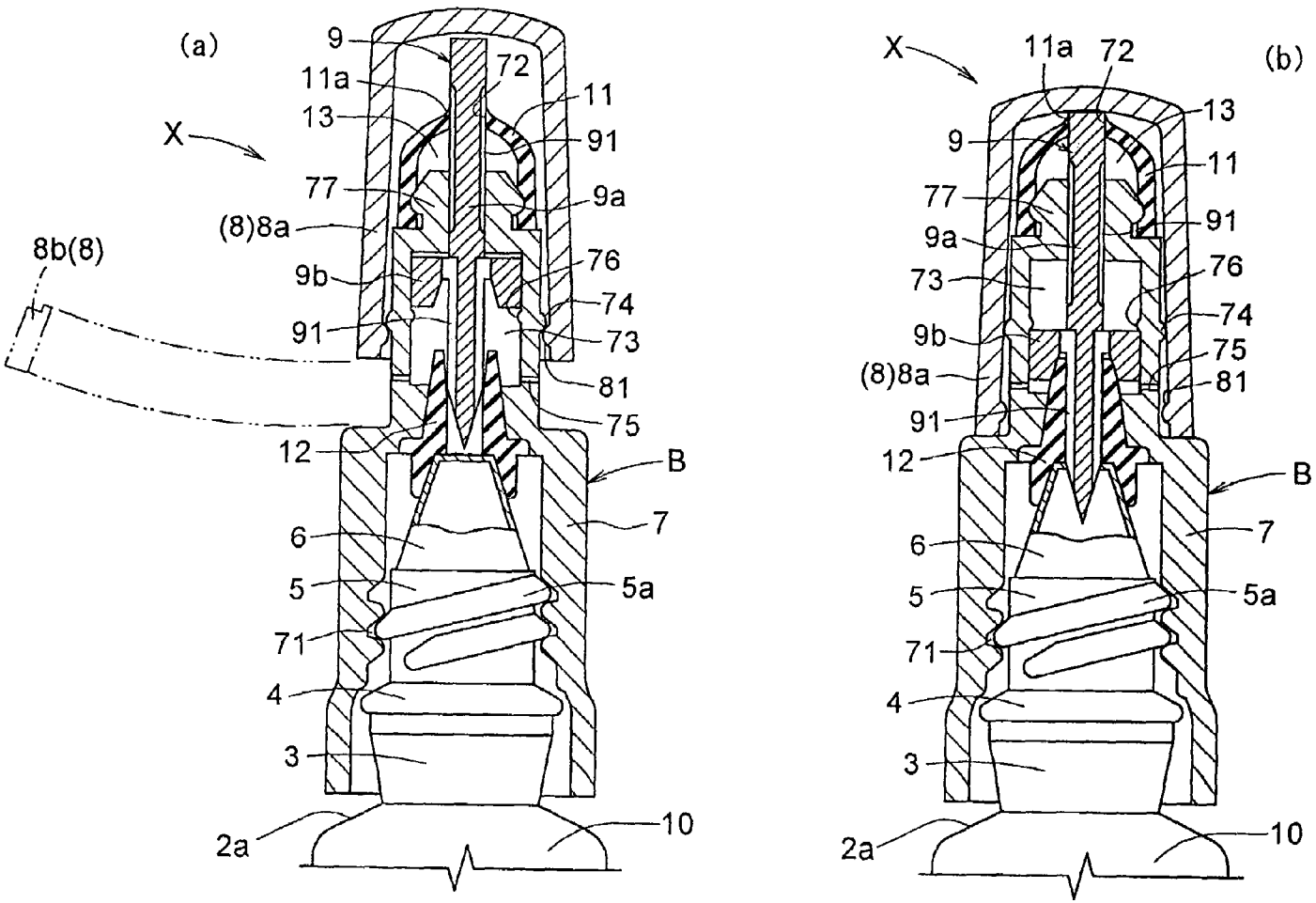
FIG. 2 is a schematic view showing states a shift from a non-pressed position to a pressed position, in which (a) is a schematic view showing the state in the non-pressed position (where a cutoff portion is removed from an overcap), while (b) is a schematic view showing the state in the pressed position (where a cap body is placed in contact with a base member)

Embodiments of the present invention will be described hereinafter with reference to the accompanying drawings. In the drawings, the parts shown with like numerals or symbols as in the prior art example indicate like or corresponding parts.

FIGS. 1 through 5 show schematic views of an eyedropper X mainly used for medical application and of principal portions of each component constituting the eyedropper X, respectively. This eyedropper X comprises an eyedrops container A including a main container body 10 capable of containing mainly a medical fluid such as medical eyedrops as a fluid, and a cap B detachably mounted on the eyedrops container A.

As the eyedrops container A, a container with an instilling tube mounted on the main container body in the form of a hollow cylinder, or an integral molding type eyedrops container A with the instilling tube and the main container body formed integrally by blow molding or vacuum forming technique are in wide use.

This embodiment will exemplify a bottle pack eyedrops container X in which the cap B is screwed to or fitted on the integral molding type eyedrops container A. Thus, the main eyedrops container 10 represents the integral molding type eyedrops container A in this embodiment.

The integral molding type eyedrops container A includes a circular bottom 1 curved inwardly, a barrel 2 in the form of a hollow cylinder continuous with a periphery of the bottom, a cylindrical neck portion 3 formed continuous from a shoulder portion 2*a* of the barrel 2, an annular stepped portion 4 bulging radially outwardly from an upper position of the neck portion 3, a threaded tube 5 with a male screw 5*a* continuously formed above the stepped portion, and an instilling tube 6 provided above the threaded tube.

The eyedrops container A may be made of a thermoplastic material such as polyethylene, polyethylene-polypropylene, polypropylene, polyethylene-terephthalate, polycarbonate and so on. The eyedrops container A formed is elastically deformable as a whole.

The instilling tube 6 does not have any construction in advance such as an instilling opening for discharging the medical fluid, in order to prevent leaking of the fluid before the eyedrops container is opened. Hence, the eyedrops container A can be maintained in a sealed condition until instillation and thus to keep the medical fluid in an aseptic condition until instillation reliably.

The container in the sealed condition referred to here is not limited to the construction where the instilling tube 6 does not have an instilling opening in advance. For example, even if an instilling opening is provided in advance, any construction may be employed as long as it is capable of reliably maintaining the sealed condition until use by providing a stopper on the instilling opening, or the like.

The cap B is detachably screwed to the male screw 5*a* of the eyedrops container A.

The cap B has the following construction.

As illustrated in FIG. 1, the cap B includes a base member 7 attachable to the eyedrops container A capable of containing the medical fluid, and an overcap 8 to be mounted on the base member 7. The overcap 8 includes a pressing member 9 inserted and maintained in the base member 7 to be slidable relative to the base member 7 and pressed toward the eyedrops container A by the overcap 8 to cancel the sealed condition of the eyedrops container A, the pressing member having a groove portion 9*a* on a side face thereof to guide the fluid to the outside, a first tight contact member 11 provided on a tip end portion 77 of the base member 7 for tight contact with the pressing member 9 from outside, and a second tight contact member 12 provided on an inner periphery of the base member 7 for tight contact with the pressing member 9 as pressed in.

The construction of each component of the cap B will be described in detail next.

(Base Member)

The base member 7 is attachable to the eyedrops container A containing the medical fluid. Thus, a threaded portion 71 is formed on the inner periphery of the base member 7 to be screwed to the male screw 5*a*.

As an example of preferred embodiment, the base member 7 may have a first communicating aperture 72 axially extending through the base member 7, and a space 73 with a larger diameter than the first communicating aperture 72 for communicating with the first communicating aperture 72. The pressing member 9 to be described later extends through the base member 7 via the first communicating aperture 72 and the space 73.

The base member 7 also has a second communicating aperture 75 formed in a side face thereof or the like for allowing air to flow in and out. The second communicating aperture 75 acts as an air intake opening when ambient air flows into the eyedrops container A in a volume corresponding to the medical fluid applied.

The base member 7 may further include a first base member projection 74 formed on an outer surface thereof for mounting thereon the overcap 8 described later, and a second base member projection 76 formed on an inner periphery of the base member 7 to secure a pressed position of the pressing member 9 described later, when pressed.

The base member 7 may be made of polypropylene, polyethylene, and so on.

The base member 7 and the eyedrops container A are not necessarily screwed together, but may be fitted to each other. In this case, any suitable constructions for allowing them to fit to each other (by providing projections, for example) are applicable to the parts corresponding to the threaded tube 5 and to the threaded portion 71.

(Overcap)

The overcap 8 is mountable on the base member 7. The mounting on the base member 7 may be effected by screwing, fitting or other method. For this purpose, the base member 7 may include a threaded portion or a projection formed on the outer surface thereof to allow the overcap 8 to be screwed or fitted thereto. In this embodiment, the base member 7 has the first base member projection 74 formed on the outer surface thereof while the overcap 8 has an inner projection 81 formed inside thereof to allow them to fit to each other.

One example of preferred embodiment of the overcap 8 includes a cap body 8*a* and a cutoff portion 8*b* to be cut off from the cap body 8*a*. After the cutoff portion 8*b* is removed, the cap body 8*a* may be placed in contact with the base member 7 when the cap body 8*a* is pressed in.

More particularly, the overcap 8 consisting of the cap body 8*a* and the cutoff portion 8*b* is mounted on the base member 7, in which the overcap 8 and the pressing member 9 are maintained in a non-pressed position to prevent them from being pressed toward the eyedrops container A. The cutoff portion 8*b* is cut off and removed from the cap body 8*a* (FIG. 2(*a*)), and then the cap body 8*a* is shifted to the pressed position where the cap body is pressed toward the eyedrops container A (FIG. 2(*b*)). As a result, the cap body 8*a* contacts the base member 7 to prevent the pressing member 9 from being pressed in more than necessary.

Since it is preferable that the overcap 8 is mounted on the base member 7 so as to cover part of the base member 7 including at least the first tight contact member 11 described later, the preferred mode of the overcap is in the form of a hollow cylinder.

The overcap 8 may be made of polypropylene, polyethylene, and the like.

(Pressing Member)

The pressing member 9 is inserted and maintained in the base member 7 to be slidable relative thereto. The pressing member 9 also includes a groove portion 91 formed on a side face thereof. The groove portion 91 may have one or more grooves on the side face of the pressing member 9. As noted above, the pressing member 9 extends through the first communicating aperture 72 and the space 73 of the base member 7. In this state, the pressing member 9 is placed in contact with the inner peripheral side of the base member 7 in order to secure the groove portion 91.

Figure 5:
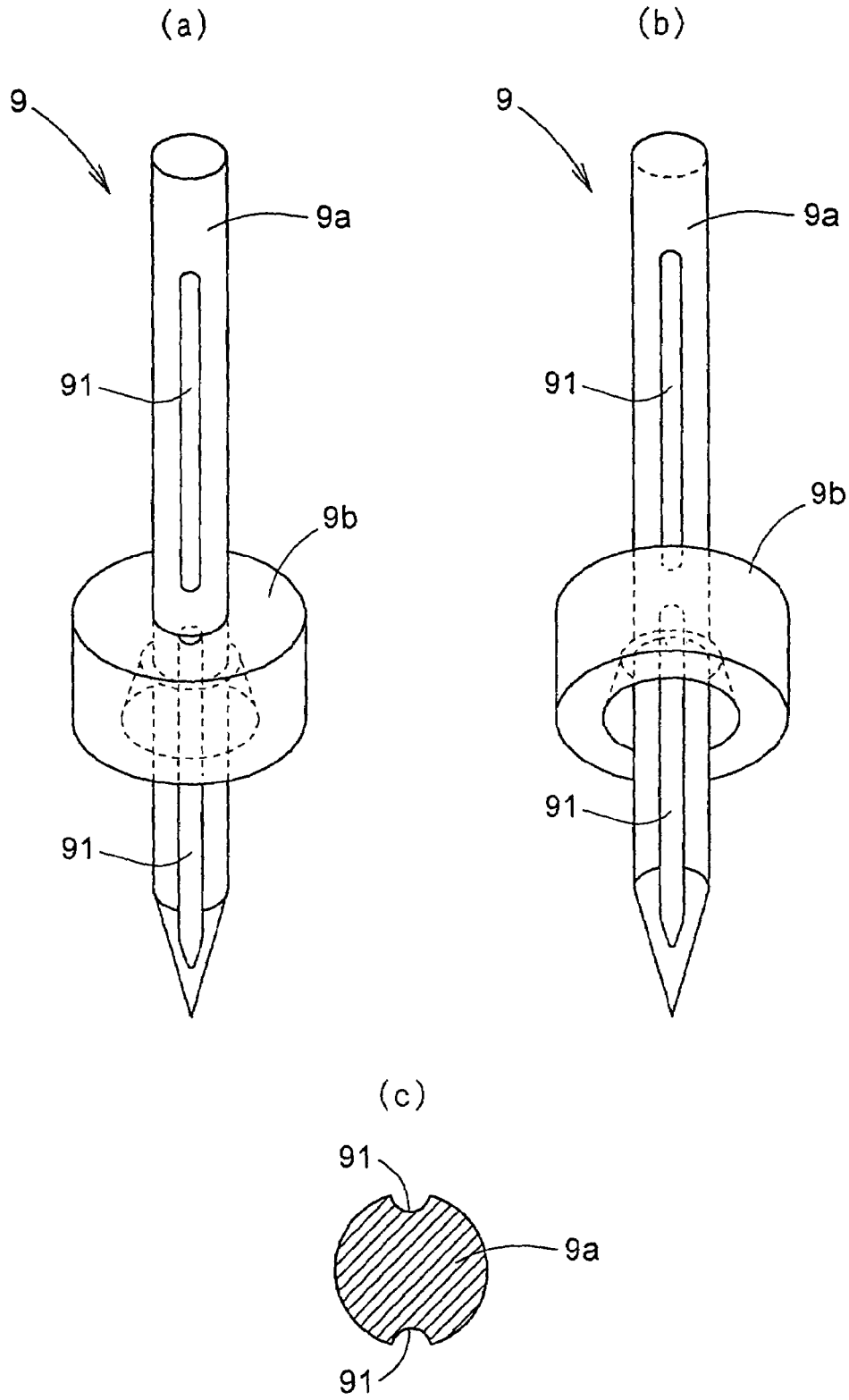
FIG. 5 is a schematic view of the pressing member.

Therefore, as shown in FIG. 5, for example, the pressing member 9 may be formed to have a stick-like axis portion 9*a* contacting the first communicating aperture 72 and a large diameter portion 9*b* contacting the space 73 and having a larger diameter than the axis portion.

In order to cancel the sealed condition of the eyedrops container A, the overcap 8 is pressed in toward the eyedrops container A to allow the pressing member 9 to be pressed in toward the eyedrops container A together with the overcap 8 (pressed position). At this time, the pressing member 9 is pressed into the instilling tube 6 of the eyedrops container A to extend and bore through part of the instilling tube 6, thereby to cancel the sealed condition. Then, the medical fluid contained in the eyedrops container A may be discharged from the bore.

As one example of the shape of the pressing member 9, a needle-like portion is formed at one end thereof adjacent the eyedrops container A here. Such a construction may facilitate perforation of the instilling tube to readily cancel the sealed condition of the eyedrops container A and thus reliably cancel the sealed condition even if the container is completely tight sealed.

The smaller the diameter of the needle portion is, the better, and the actual diameter should be between about Φ0.1 mm and Φ0.5 mm.

In this case, the instilling tube 6 may have a bottomed conical recess formed therein with an inside diameter progressively increasing toward the tip of the instilling tube 6. This makes the shape and size of the instilling bore produced by perforation uniform.

A further embodiment may already have the instilling bore formed in the instilling tube 6 with a stopper mounted on the instilling bore, thereby to maintain the container in the sealed condition. In this case, the pressing member 9 should employ a removable stopper. More particularly, the pressing member 9 may be formed flat at one end thereof adjacent the eyedrops container A. When the pressing member 9 is pressed in, the stopper is pressed into the eyedrops container A to be removed from the instilling tube 6, which may readily cancel the sealed condition of the eyedrops container A.

The pressing member 9 may be made of any materials suitable for canceling the sealed condition of the eyedrops container A, including a thermoplastic resin or the like which is more durable than the eyedrops container A.

(First Tight Contact Member)

The first tight contact member 11 is placed in tight contact with the pressing member 9 from outside and fixed to the tip end portion 77 of the base member 7. However, the first tight contact member 11 is not fixed to the pressing member 9, but simply placed in tight contact therewith. Thus, the first tight contact member 11 is readily movable away from the pressing member 9 (see FIG. 3).

In this state, a second space 13 surrounded by the first tight contact member 11, the pressing member 9 and the base member 7 may be provided, in which the medical fluid may temporarily be stored before being discharged to the outside.

In order to facilitate touch-off and fix the quantity of one drop (within the range of 25 to 50 μL), an annular projection 11*a* is preferably provided outwardly of the portion where the first tight contact portion 11 is placed in tight contact with the pressing member 9.

The first tight contact member 11 is fixed to the tip end portion 77 of the base member 7 and is desirably made of an elastic material such as rubber to be readily movable away from the pressing member 9.

(Second Tight Contact Member)

The second tight contact member 12 is provided on the inner periphery of the base member 7 to contact the pressing member 9 tightly.

More particularly, the second tight contact member 12 has a portion to contact the pressing member 9 tight when the latter is placed in the pressed position. In other words, in the non-pressed position where the pressing member 9 is not in the pressed position (FIG. 4(*a*)), the second tight contact member 12 is not placed in tight contact with the pressing member 9 (first position). However, when the pressing member 9 is in the pressed position (FIG. 4(*b*)), the second tight contact member 12 is placed in tight contact with the pressing member 9 (second position). Thus, the second tight contact member 12 is placed in tight contact with the pressing member 9 only when the later is in the pressed position, and the second tight contact member 12 can therefore be prevented from having a particular tendency in its shape. Consequently, the second tight contact member 12 can be reliably placed in tight contact with the pressing member 9 in use.

It is preferable that the second tight contact member 12 adjacent the eyedrops container A should contact the eyedrops container A (instilling tube 6). At this time, the instilling tube 6 can be prevented from being deformed if the second tight contact member 12 supportingly contacts the instilling tube 6.

As is the fist tight contact member 11, the second tight contact member 12 is preferably made of an elastic material such as rubber, polyethylene, polypropylene and so on.

As noted above, the cap B comprises the base member 7, the overcap 8, the pressing member 9, the first tight contact member 11 and the second tight contact member 12. This construction of the cap B allows use of the sealed eyedrops container A containing the medical fluid.

More particularly, in use of the eyedropper X consisting of the eyedrops container A and the cap B having the above-noted construction, the overcap 8 is pressed toward the eyedrops container A to shift the pressing member 9 from the non-pressed position to the pressed position, thereby to cancel the sealed condition of the eyedrops container A. At this time, the sealed condition of the eyedrops container A is canceled by perforating the instilling tube 6, removing the stopper or the like. This allows the medical fluid contained in the eyedrops container A to discharge from the eyedrops container A. As a result, the sealed condition of the eyedrops container A is readily cancelable by a simple operation to press in the pressing member 9.

Then, the barrel 2 of the eyedrops container A is pressed by digits or the like with the overcap 8 being removed from the base member 7, thereby to discharge the medical fluid from the eyedrops container A. The medical fluid discharged from the eyedrops container A is guided to the outside through the groove portion 91 formed in the pressing member 9. In this case, since the second tight contact member 12 is in the second position (FIG. 4(*b*)), the medical fluid is not discharged through any other passages (the second communicating aperture 75, for example) than the groove portion 91, which prevents the fluid from leaking from the eyedrops container A.

Figure 3:
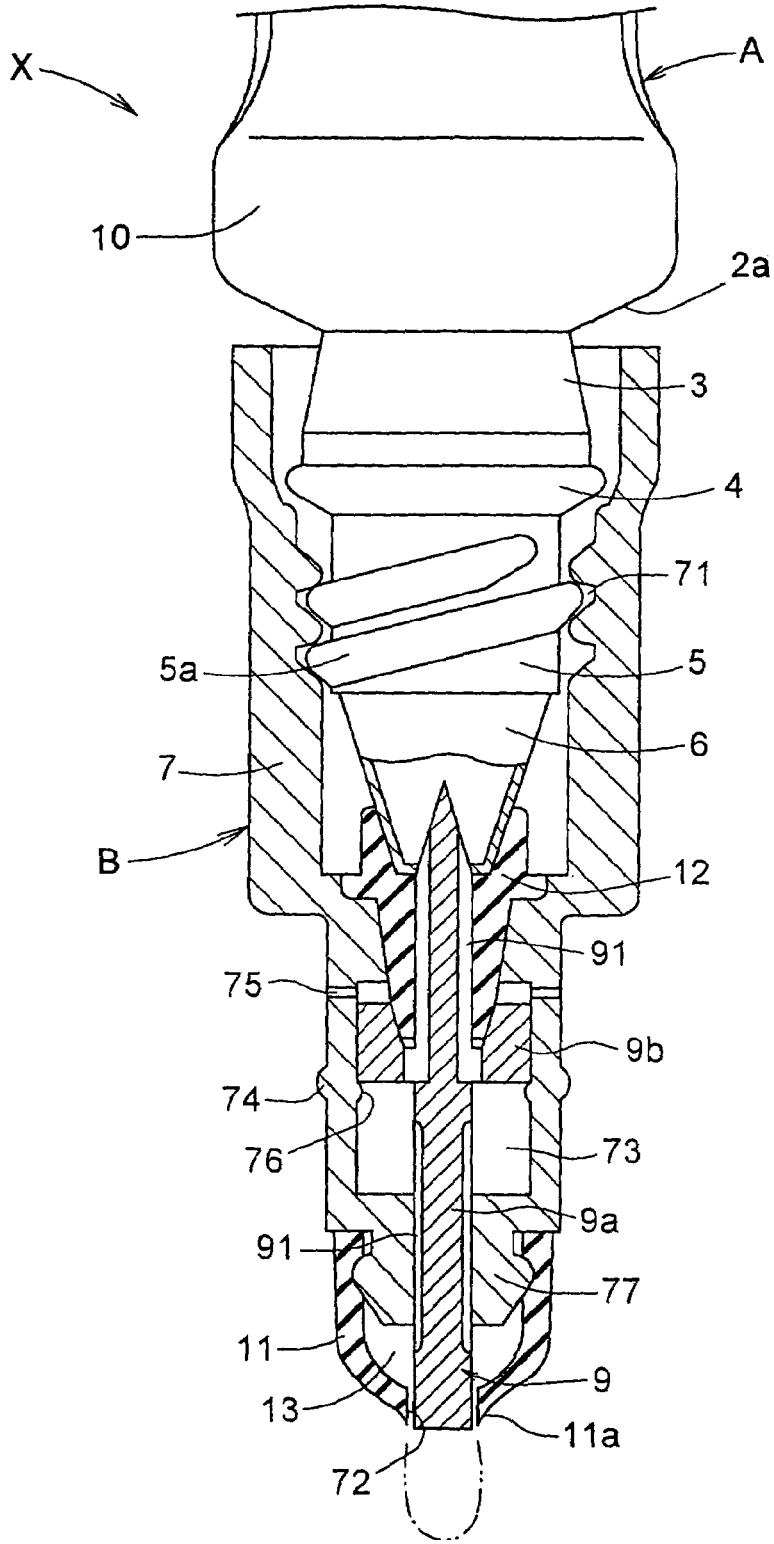
FIG. 3 is a schematic view of principal portions in a state where a medical fluid drips in time of instillation.
Figure 4:
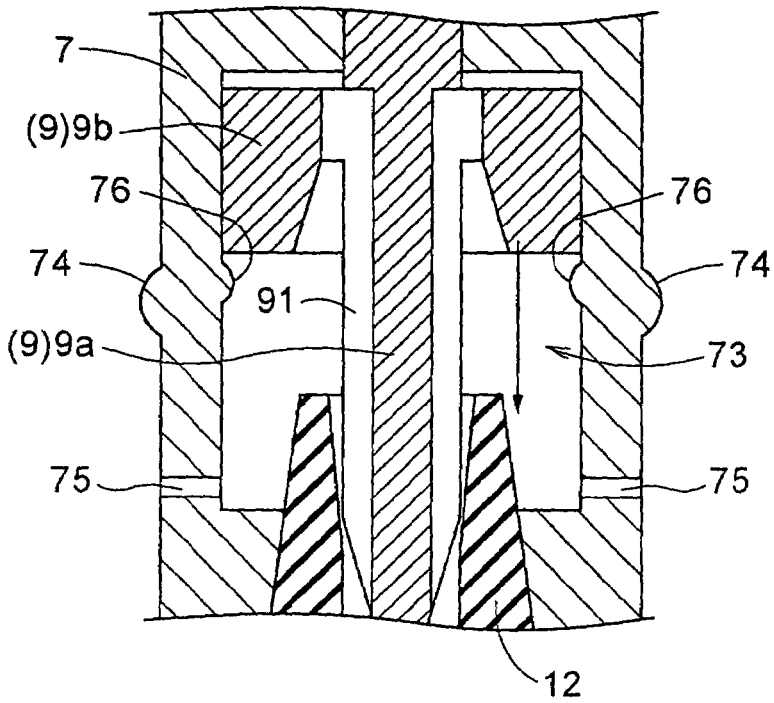
FIG. 4 is a schematic view of principal portions showing the shift the non-pressed position to the pressed position, in which (a) is a schematic view showing the state in the non-pressed position, while (b) is a schematic view showing the state in the pressed position (where a pressing member is placed in tight contact with a second tight contact member)
Figure 4:
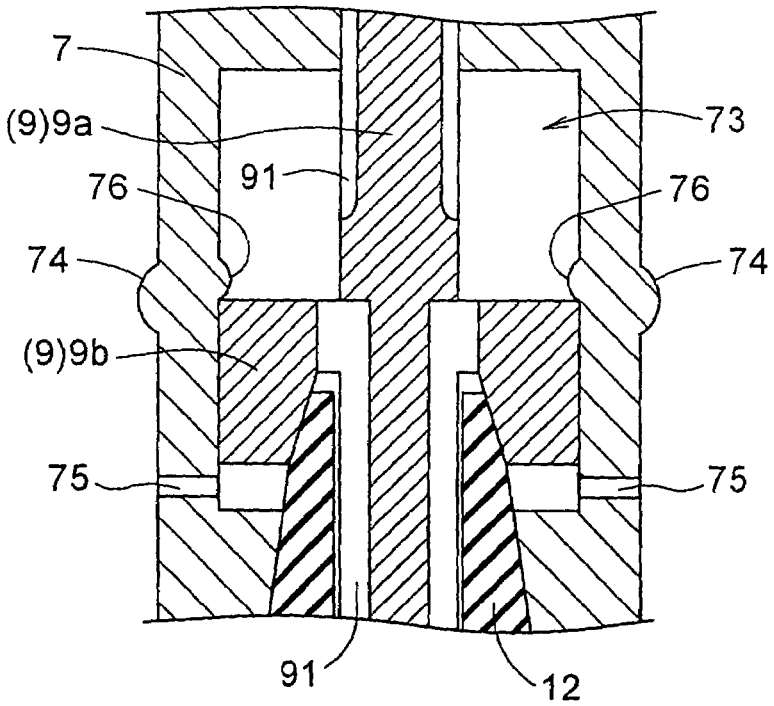

Furthermore, the medical fluid guided by the groove portion 91 is temporarily stored in the second space 13. When the second space 13 is filled up with the medical fluid, the first tight contact member 11 and the pressing member 9 which are placed in tight contact with each other by the pressure of the medical fluid are easily moved away from each other, thereby to allow the medical fluid to be discharged to the outside (FIG. 3).

ALTERNATIVE EMBODIMENT 1

Figure 6:
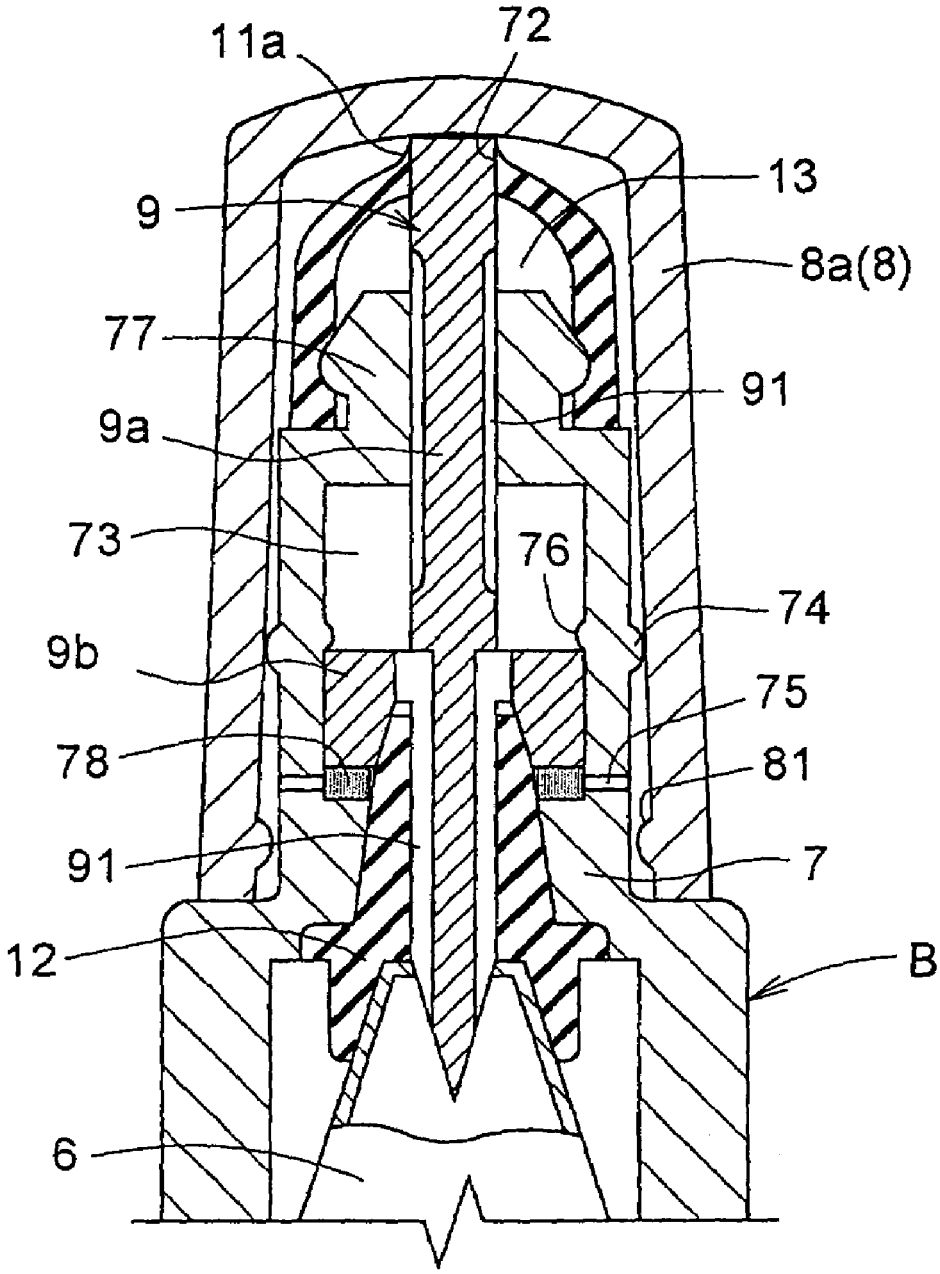
FIG. 6 is a schematic view of principal portions in a state where a filter member is provided between the pressing member and the base member.

In the embodiment described above, a filter member 78 may be held by the pressing member 9 and the base member 7 with the pressing member 9 being pressed in (FIG. 6).

In a use state in which the sealed condition of the eyedrops container is canceled, ambient air flows into the eyedrops container A in a volume corresponding to the medical fluid applied for instillation. The air is taken in from the second communicating aperture 75 to flow into the eyedrops container A through between the pressing member 9 and the base member 7.

Since the filter member 78 is provided to be held by the pressing member 9 and the base member 7 with the pressing member 9 being pressed in, particles and microorganisms present in the air can be captured by the filter 78, even if the air flows in in the volume corresponding to the medical fluid applied. This prevents the medical fluid contained in the eyedrops container A from being polluted by the air, thereby to effectively prevent pollution of the medical fluid.

Moreover, since the filter member 78 is provided to be held by the pressing member 9 and the base member 7 with the pressing member 9 being pressed in, the filter member 78 is pressed by the pressing member 9 when the pressing member 9 is placed in the pressed position. This prevents the filter member 78 from being pressed until use, which can preserve the filter member 78 in a good condition without deteriorating the shape and the filtering function thereof.

The filter of the filter member 78 is preferably made of a porous material such as filter paper. The filter paper with numeral porosities of about 0.1 through 7 μm is more desirable because particles and microorganisms present in the air can be effectively captured.

ALTERNATIVE EMBODIMENT 2

Figure 7:
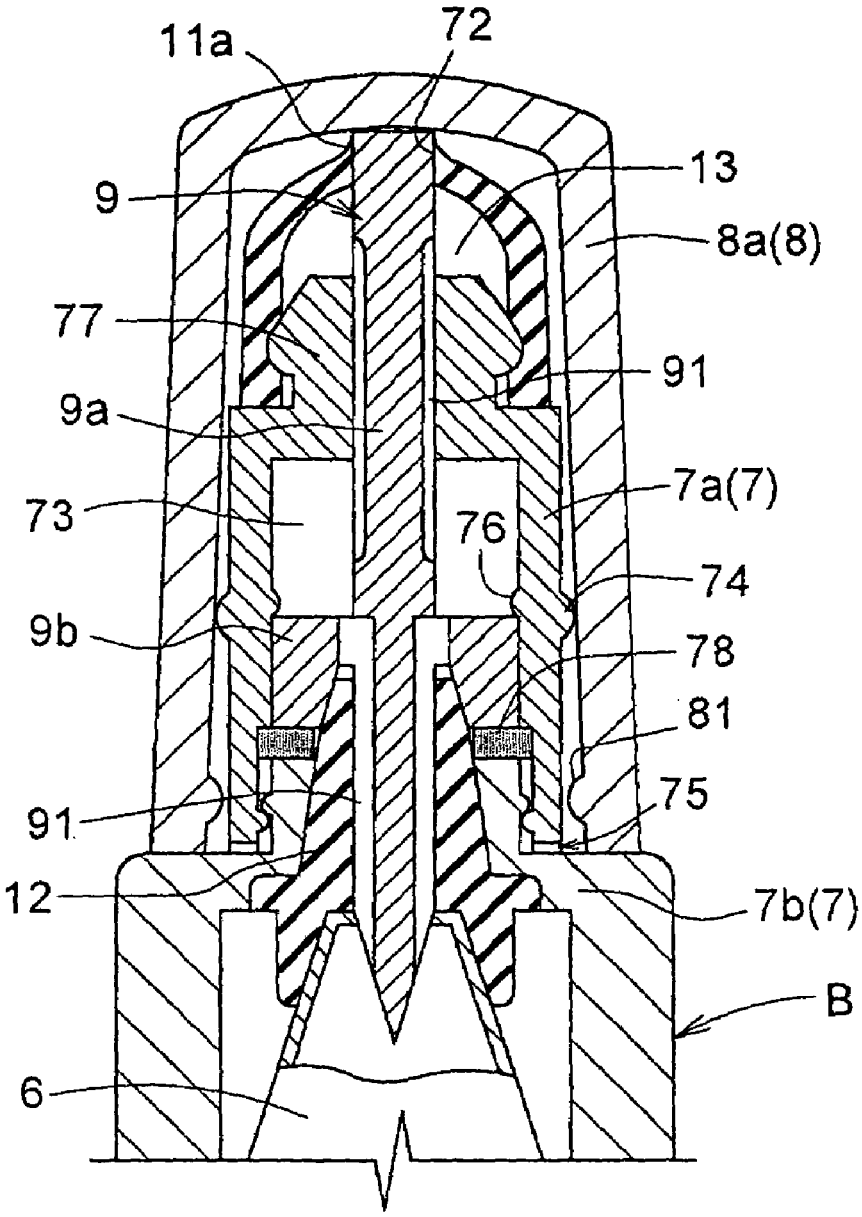
FIG. 7 is a schematic view of principal portions in a state where the base member includes a first base member and a second base member, the filter member being fixed at an outer periphery thereof by the first and second base members.

In the construction described in the above alternative embodiment 1, the base member 7 may include a first base member 7*a* and a second base member 7*b*, in which the filter member 78 is fixed at an outer periphery thereof by the first base member 7*a* and the second base member 7*b* before the pressing member 9 is pressed in (FIG. 7).

Thus, the filter member 78 is fixed at the outer periphery thereof by the first base member 7*a* and the second base member 7*b*, thereby to stabilize the position of the filter member 78. As a result, the filter member 78 is prevented from being held by the first base member 7*a* and the second base member 7*b* in an abnormal position, thereby to reliably perform the filtering function.

In this case, a gap produced between the first base member 7*a* and the second base member 7*b* may serve as the second communicating aperture 75.

ALTERNATIVE EMBODIMENT 3

Figure 8:
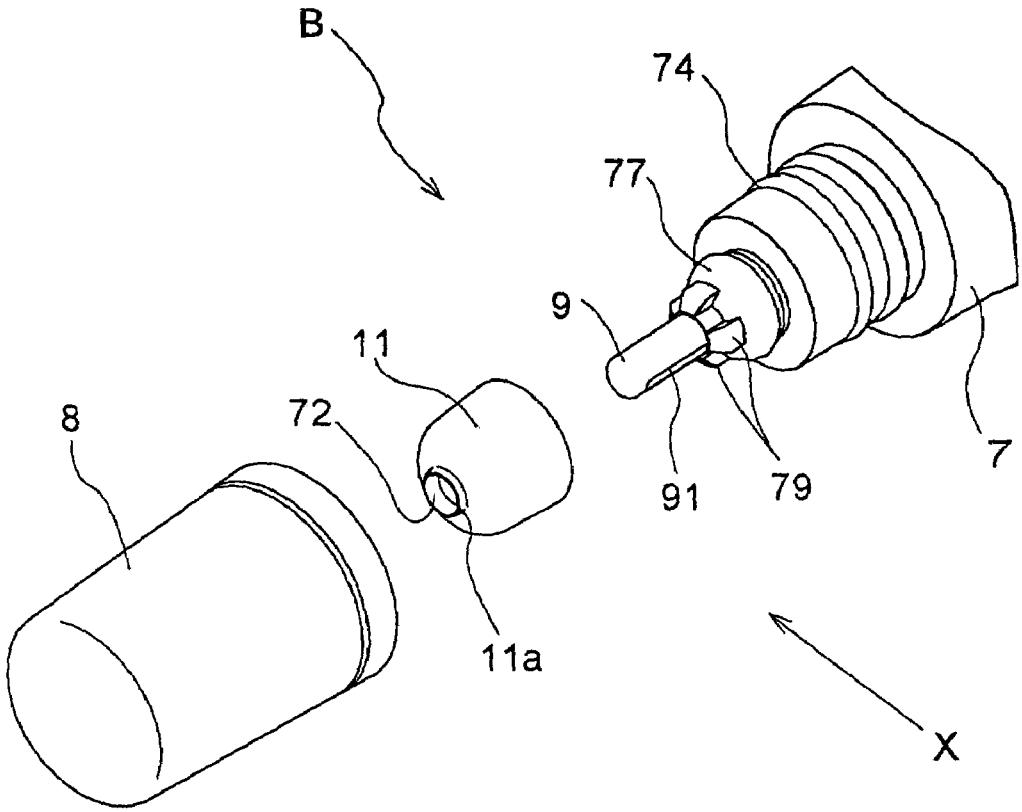
FIG. 8 is a schematic view of projections dispersed on a tip end portion of the base member.
Figure 9:
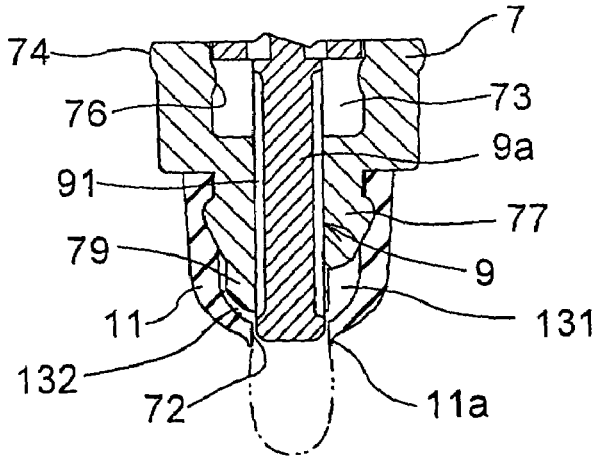
FIG. 9 is a schematic view of principal portions of the projections dispersed on the tip end portion of the base member.

In the embodiments described above, projections 79 may be dispersed on the tip portion 77 of the base member 7 for restraining the first tight contact member 11 from being deformed toward the base member 7 (FIG. 8). The projections 79 are desirably arranged close to the first tight contact member 11 (FIG. 9).

The first tight contact member 11 may have a possibility of being deformed toward the base member 7 by the friction between the pressing member 9 and the first tight contact member 11 when the pressing member 9 is placed in the pressed position. However, even if the first tight contact member 11 is deformed toward the base member 7, the projections 79 dispersed on the tip end portion of the base member 7 (FIG. 8) are allowed to contact the first tight contact member 11 generally evenly around the tip end portion of the base member 7. Hence, the first tight contact member 11 may be deformed, its irregular distortion hardly occurs. This prevents the medical fluid from discharging irregularly.

Further, since the projections 79 are arranged close to the first tight contact member 11 (FIG. 9), the first tight contact member 11 is placed in contact with the projections 79 immediately when the first tight contact member 11 is about to deform toward the base member 7, thereby to stop movement of the first tight contact member 11. As a result, a deformation of the first tight contact member 11 can be minimized, if any.

Still further, since the projections 79 are dispersed on the tip end portion of the base member 7 for restraining the first tight contact member 11 from being deformed toward the base member 7 and also arranged close to the first tight contact member 11, a space between the projections 79 and surrounded by the first tight contact member 11 and the pressing member 9 defines a large space 131. On the other hand, since the projections 79 are arranged close to the first tight contact member 11, a space surrounded by each projection 79, the first tight contact member 11 and the pressing member 9 defines a small space 132.

As a result, the space for temporarily storing the medical fluid can be secured by the large space 131 and the small space 132.

ALTERNATIVE EMBODIMENT 4

The foregoing embodiments illustrate the bottle pack eyedropper X including the integrally formed eyedrops container A to which the cap B is screwed or fitted. As a further alternative modification, a three-piece type eyedropper X' will be set forth hereinafter.

Figure 10:
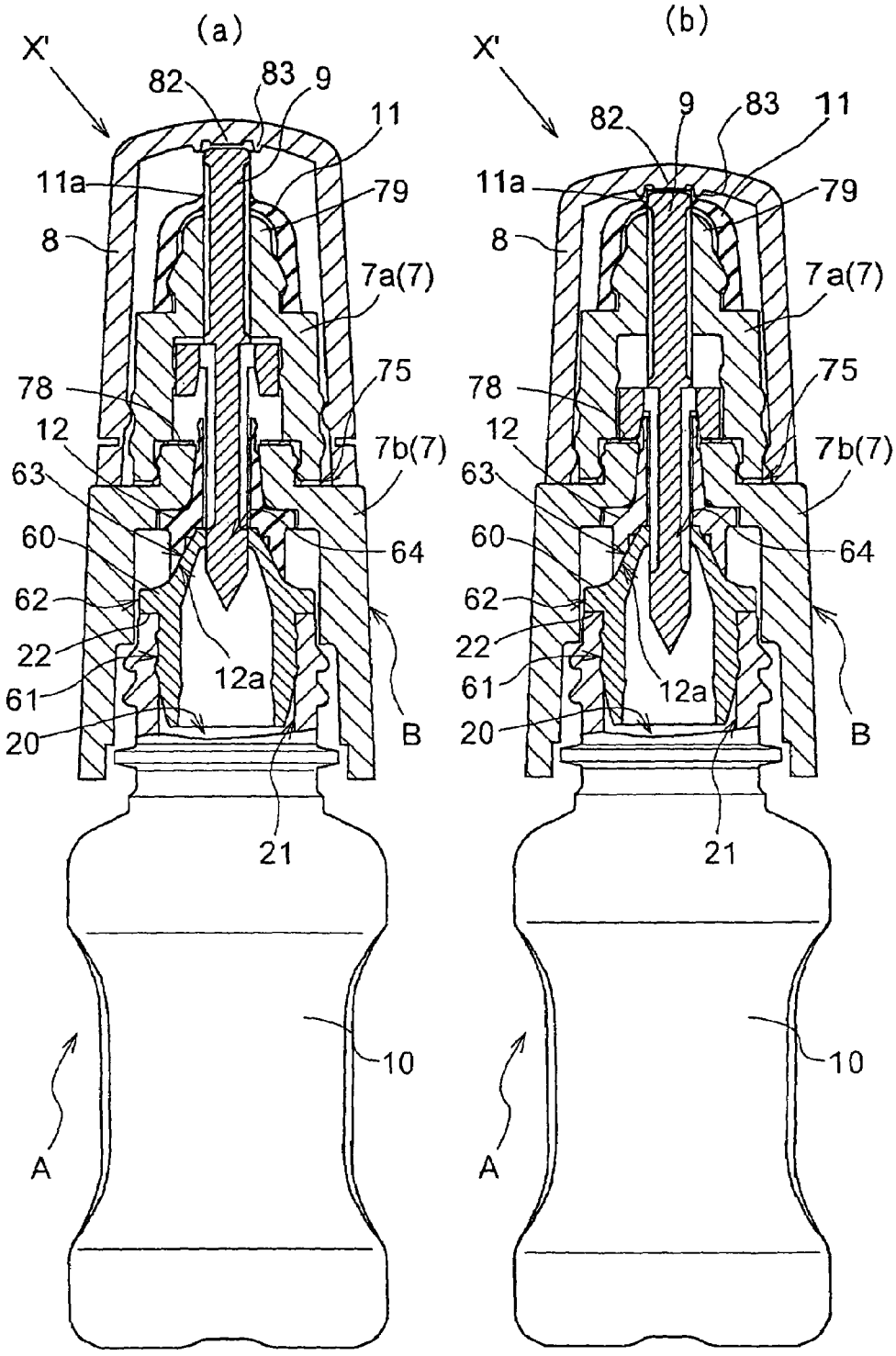
FIG. 10 is a schematic view of a three-piece type eyedropper according to the present invention, in which (a) is a schematic view of the eyedropper in the non-pressed position, while (b) is a schematic view of the eyedropper in the pressed position.
Figure 11:
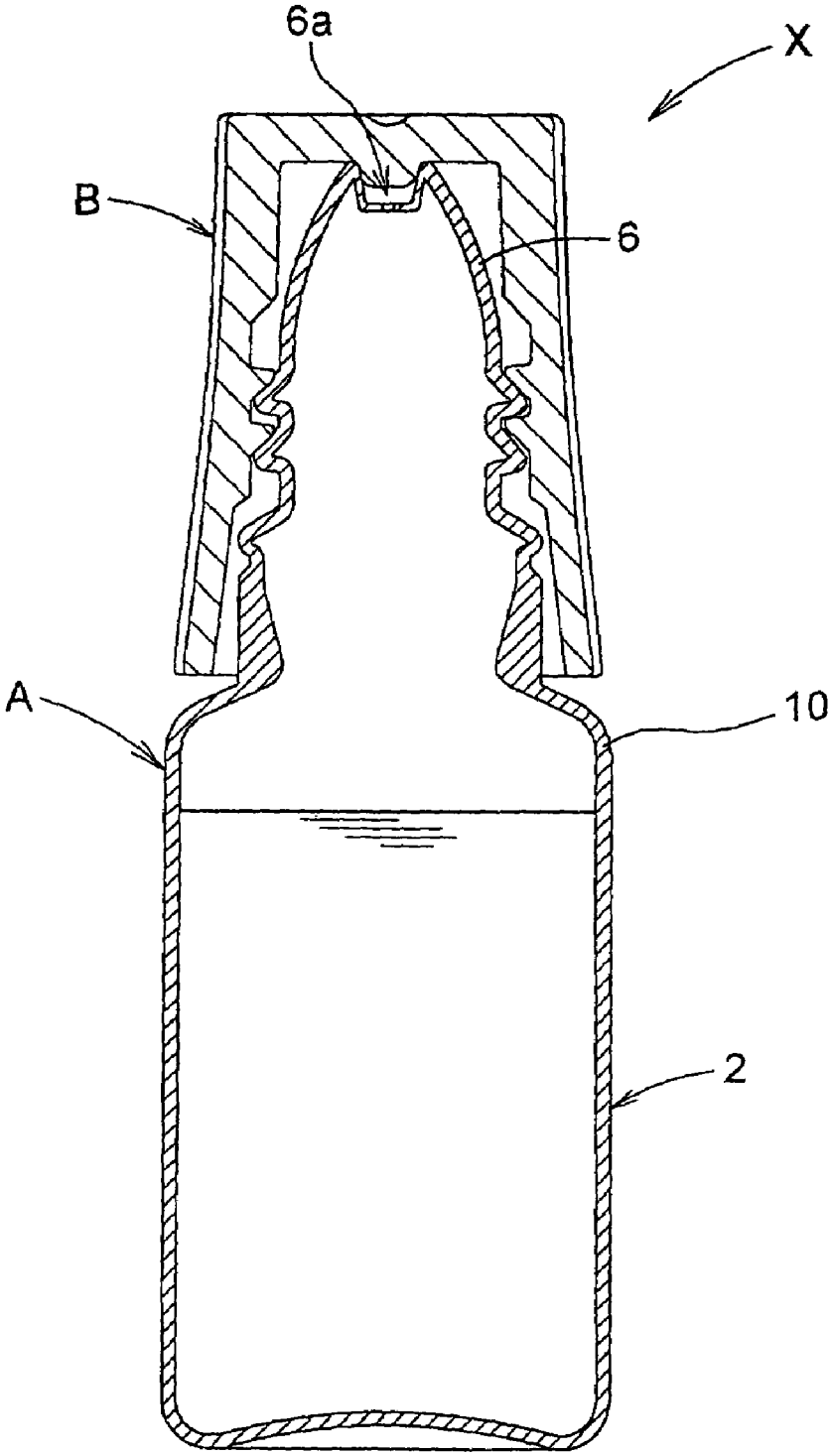
FIG. 11 is a schematic sectional view of a conventional eyedropper.

As illustrated in FIG. 10, the three-piece type eyedropper X' includes a main container body 10 in the form of a hollow cylinder, an instilling tube 60 provided separately from the main container body 10, and a cap B. Thus, in this embodiment, the unit consisting of the main container body 10 and the instilling tube 60 is referred to as an eyedrops container A.

The instilling tube 60 is fitted in an opening 20 of the main container body 10, while the cap B is detachably screwed to the main container body 10, thereby to constitute the three-piece type eyedropper X'.

The cap B and the eyedrops container A will be described, respectively, hereinafter.

(Cap)

The cap B may have the same construction as in the foregoing embodiments.

For example, FIG. 10 shows a construction in which the base member 7 includes the first base member 7*a* and the second base member 7*b*. This construction employs the filter member 78 fixed at the outer periphery thereof by the first base member 7*a* and the second base member 7*b* before the pressing member 9 is pressed in (see the alternative embodiment 2), or the projections 79 dispersed on the tip end portion of the base member 7 for restraining the first tight contact member 11 from being deformed toward the base member 7 (see the alternative embodiment 3).

An overcap projection 82 may be provided in an inner wall of the overcap 8 at a top portion thereof to contact and engage the pressing member 9 when the pressing member 9 is pressed in to the pressed position.

Further, it is desirable to provide an engaging portion 83 in the inner wall of the overcap 8 at the top portion thereof to prevent the annular projection 11*a* from being deformed outwardly.

The engaging portion 83 is placed in contact with an outer surface (which does not contact the pressing member 9) of the annular projection 11*a* in the pressed position (FIG. 10(*b*)). With this construction, the outer surface of the annular projection 11*a* is engaged with the engaging portion 83 even if a great pressing force is exerted on the top portion of the overcap 8 in keeping the container when or after the cap is pressed in, which hardly causes outward deformation of the annular projection 11*a* and the like. Thus, leakage of the medical fluid can be prevented in time of keeping the eyedrops container and so on. As the annular projection 11*a* is further urged toward the pressing member 9 by the engaging portion 83, the degree of tight contact between the first tight contact member 11 and the pressing member 9 is increased and a further effect of preventing leak of the medical fluid can be expected.

Still further, a dent portion may be defined at the boundary between the overcap projection 82 and the engaging portion 83 for receiving the annular projection 11*a*. Such a construction allows the annular projection 11*a* to fit in the dent portion in the pressed position. In this state, the annular projection 11*a* contacts less often the inner wall of the top portion of the overcap 8 compared with the construction dispensing with the dent portion. Therefore, deformation of the annular projection 11*a* can be prevented.

Other components of the cap B are the same as in the above examples, and any further description will be omitted.

(Eyedrops Container)

As set forth above, the main container body 10 and the instilling tube 60 together constitute the eyedrops container A in this embodiment.

Since the main container body 10 in the form of a hollow cylinder has the same construction as in the above-noted embodiment except for the provision of the opening 20, any further description will be omitted.

The instilling tube 60 includes an engaging portion 62 engageable with an end portion 22 of an opening of the main container body 10, a tapered face 63 placed in tight contact with a face 12*a* of the second tight contact member 12 adjacent the container, and an instilling opening 64 for discharging the medical fluid.

For preventing leakage of medical fluid inside the main container body 10, this main container body 10 and the instilling tube 60 are attached to each other by placing an inner wall 21 of the opening in tight contact with an outer wall 61 of the instilling tube and further by engaging the engaging portion 62 with the end portion 22 of the opening.

The instilling tube 60 is placed in contact with the second tight contact member 12. More particularly, the face 12*a* of the second tight contact member 12 adjacent the container is placed in tight contact with the tapered face 63 of the instilling tube 60 when the cap B is screwed to the main container body 10. This can prevent the medical fluid from leaking from a gap between the second tight contact member 12 and the instilling tube 60.

The instilling tube 60 has the instilling opening 64 which is sealed by the pressing member 9 when the pressing member 9 is in the non-pressed position (FIG. 10(*a*)). When the pressing member 9 is pressed in to the pressed position (FIG. 10(*b*)), the groove portion 91 communicates with an interior of the main container body 10. This construction can cancel the sealed condition of the eyedrops container A.

The present invention is not limited to the embodiments described above, but may be suitably modified in each component as long as the like functions and effects are performed.

INDUSTRIAL UTILITY

The antipollution cap according to the present invention may be used in a medical eyedrops container and the like for containing medical eyedrops.

The invention claimed is:

1. An antipollution cap comprising:

a base member (7) attachable to a main container body (10) for containing a fluid;

an overcap (8) mountable on the base member (7);

a pressing member (9) inserted into and held by the base member (7) to be slidable relative thereto, with a groove portion (91) formed in a side face thereof for guiding the fluid to the outside, the pressing member being pressable toward the main container body (10) by the overcap (8) to cancel a sealed condition of the main container body (10);

a first tight contact member (11) provided on a tip end portion (77) of the base member (7) to be placed in tight contact with the pressing member (9) from outside and yet allow the fluid to be discharged therethrough; and a second tight contact member (12) provided on an inner periphery of the base member (7) to be placed in tight contact with the pressing member (9) in a pressed position thereby preventing the fluid from being discharged therethrough and yet allowing ambient air to flow therein.

2. The antipollution cap as defined in claim 1 wherein the pressing member (9) includes one end in the form of a needle adjacent the main container body (10).

3. The antipollution cap as defined in claim 1 or 2 further comprising a filter member (78) held by the pressing member (9) and the base member (7) with the pressing member (9) being pressed in.

4. The antipollution cap as defined in claim 3 wherein the base member (7) includes a first base member (7*a*) and a second base member (7*b*), the filter (78) being fixed at an outer periphery thereof by the first base member (7*a*) and the second base member (7*b*) before the pressing member (9) is pressed in.

5. The antipollution cap as defined in claim 4 wherein the overcap (8) includes a cap body (8*a*) and a cutoff portion (8*b*) to be cut off from the cap body (8*a*), the cap body (8*a*) being placed in contact with the base member (7) when it is pressed in after the cutoff portion (8*b*) is removed.

6. The antipollution cap as defined in claim 5 further comprising projections (79) dispersed on the tip end portion of the base member (7) for restraining the first tight contact member (11) from being deformed toward the base member (7), the projections (79) being arranged close to the first tight contact member (11).

* * * * *